US007059698B1

(12) United States Patent
Marra, III et al.

(10) Patent No.: US 7,059,698 B1
(45) Date of Patent: Jun. 13, 2006

(54) METHOD OF ALTERING AN EFFECTIVE PRINT RESOLUTION OF AN INK JET PRINTER

(75) Inventors: Michael A. Marra, III, Lexington, KY (US); Randall D. Mayo, Georgetown, KY (US); Marc A. Herwald, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 240 days.

(21) Appl. No.: 10/265,469

(22) Filed: Oct. 4, 2002

(51) Int. Cl.
*B41J 29/38* (2006.01)

(52) U.S. Cl. ..... 347/9; 347/37

(58) Field of Classification Search ..... 347/6, 347/84, 40, 41, 42, 43, 14, 37, 16, 20, 39, 347/9

See application file for complete search history.

(56) References Cited

U.S. PATENT DOCUMENTS 4,097,873 A 6/1978 Martin
4,167,014 A 9/1979 Darling et al.
4,216,480 A 8/1980 Buehner et al.
5,359,355 A * 10/1994 Nagoshi et al. ..... 347/9
5,483,605 A 1/1996 Rostamian
5,527,121 A * 6/1996 Santon ..... 400/323
5,541,625 A 7/1996 Holstun et al.
5,600,351 A 2/1997 Holstun et al.
5,604,597 A 2/1997 Imai
5,606,350 A 2/1997 Koyama
5,648,805 A 7/1997 Keefe et al.
5,736,993 A 4/1998 Regimabal et al.
5,745,128 A 4/1998 Lam et al.
5,751,470 A 5/1998 Damon
5,767,870 A 6/1998 Klasssen et al.
5,788,385 A * 8/1998 Inoue et al. ..... 400/279
5,982,998 A 11/1999 Takahashi et al.
5,992,968 A * 11/1999 Uetsuki et al. ..... 347/37
6,003,969 A 12/1999 Freret, Jr.
6,022,104 A 2/2000 Lin et al.
6,033,053 A 3/2000 Eun
6,042,281 A 3/2000 Ohtani
6,049,393 A 4/2000 Knierim et al.
6,132,022 A 10/2000 Akiyama et al.
6,164,773 A * 12/2000 Oikawa ..... 347/100
6,217,150 B1 * 4/2001 Heydinger ..... 347/43
6,234,613 B1 5/2001 Feinn et al.
6,244,690 B1 6/2001 Kwon et al.
6,270,185 B1 8/2001 Askeland
6,293,641 B1 9/2001 Yoshimura et al.
6,293,651 B1 9/2001 Sawano
6,318,827 B1 * 11/2001 Brenner et al. ..... 347/9
6,338,542 B1 1/2002 Fugimori
6,354,691 B1 3/2002 Uchikata
6,367,908 B1 4/2002 Serra et al.
6,439,686 B1 * 8/2002 Glass ..... 347/40
6,467,894 B1 * 10/2002 Misumi ..... 347/101

(Continued)

*Primary Examiner*—Manish Shah
*Assistant Examiner*—Leonard Liang
(74) *Attorney, Agent, or Firm*—Taylor & Aust

(57) ABSTRACT

A method of printing using an ink jet printer includes the steps of: defining at least one scan line with a plurality of pixel locations spaced apart at a predetermined print resolution; scanning a printhead across the scan line at a first velocity; printing on the scan line at selected pixel locations at the first scan velocity; scanning the printhead across the scan line at a second scan velocity which is different from the first scan velocity; and printing on the scan line at selected pixel locations at the second scan velocity.

17 Claims, 3 Drawing Sheets

U.S. PATENT DOCUMENTS 6,609,777 B1 * 8/2003 Endo ..... 347/19
6,715,856 B1 * 4/2004 Mihara ..... 347/37
6,860,588 B1 * 3/2005 Holstun et al. ..... 347/47
6,880,909 B1 * 4/2005 King et al. ..... 347/19
2001/0015734 A1 8/2001 Kanda et al.
2001/0040596 A1 11/2001 Lee et al.
2002/0039121 A1 4/2002 Ho et al.
2002/0057303 A1 5/2002 Takahashi et al.

* cited by examiner

METHOD OF ALTERING AN EFFECTIVE PRINT RESOLUTION OF AN INK JET PRINTER

BACKGROUND OF THE INVENTION

1. Field of the Invention

The present invention relates to ink jet printers, and, more particularly, to a method of altering an effective print resolution of an ink jet printer.

2. Description of the Related Art

An ink jet printer includes a carrier which moves in scan directions across an image area overlying a print medium. The carrier carries a printhead having a plurality of ink jetting orifices. Electronic control circuitry activates ink jetting heaters within the printhead to selectively jet ink drops from the ink jetting orifices as the printhead is scanned across the image area. The ink drops are placed at selected pixel locations in rows or scan lines of the image area. The print medium moves in an advance direction between scans a predetermined amount. In a multi-pass operation, multiple ink jetting orifices overly a given scan line for placing ink drops at selected pixel locations. In the case of color printing, multiple printheads are typically used, with each printhead being associated with a primary color ink. Depending upon the combination of different color inks which are placed at a given pixel location, different colors are produced.

The print resolution of a printed document is an important print quality parameter. In general, the image area is divided into a two dimensional array of rows and columns of pixels. The pixels usually have a common spacing in a vertical as well as horizontal direction. For example, the pixels may have a center to center spacing of 600 dots per inch (dpi) or 1200 dpi. A higher print resolution usually is preferred from a quality standpoint.

The print resolution to some extent is governed by electrical and mechanical constraints associated with a particular printer. For example, the ink jetting heaters within a printhead have thermal response times associated with activating and deactivating the heater. Further, the electronic circuitry is only capable of handling a predetermined number of instructions per duty cycle.

What is needed in the art is a method of altering (e.g., increasing) the print resolution of an ink jet printer using existing printer architecture or not significantly altering the architecture.

SUMMARY OF THE INVENTION

The present invention relates to a method of altering the effective print resolution of an ink jet printer, wherein a printhead is scanned across a scan line during a first scan at a first scan velocity and during a second scan at a second scan velocity, thereby altering the ink drop placement locations between scans to in turn alter the effective print resolution.

The invention comprises, in one form thereof, a method of printing using an ink jet printer, including the steps of: defining at least one scan line with a plurality of pixel locations spaced apart at a predetermined print resolution; scanning a printhead across the scan line at a first velocity; printing on the scan line at selected pixel locations at the first scan velocity; scanning the printhead across the scan line at a second scan velocity which is different from the first scan velocity; and printing on the scan line at selected pixel locations at the second scan velocity.

The present invention comprises, in another form thereof, a method of altering the effective print resolution of an ink jet printer including the steps of defining at least one scan line having a predetermined print resolution; scanning a printhead during a first scan across the scan line at a first scan velocity; printing on the scan line during the first scan at the predetermined print resolution; scanning the printhead during a second scan across the scan line at a second scan velocity which is different from the first scan velocity; and printing on the scan line during the second scan at the predetermined print resolution, thereby altering the effective print resolution of the ink jet printer.

An advantage of the present invention is that the print resolution of the ink jet printer may be altered to a desired effective print resolution.

Another advantage is that the print resolution may be altered using software which utilizes the same firmware and hardware of existing printers.

Yet another advantage is that the printhead velocity during the second scan may be calculated using a predetermined offset between the ink drop placement locations associated with the different printhead velocities.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

DETAILED DESCRIPTION OF THE INVENTION

Figure 1:
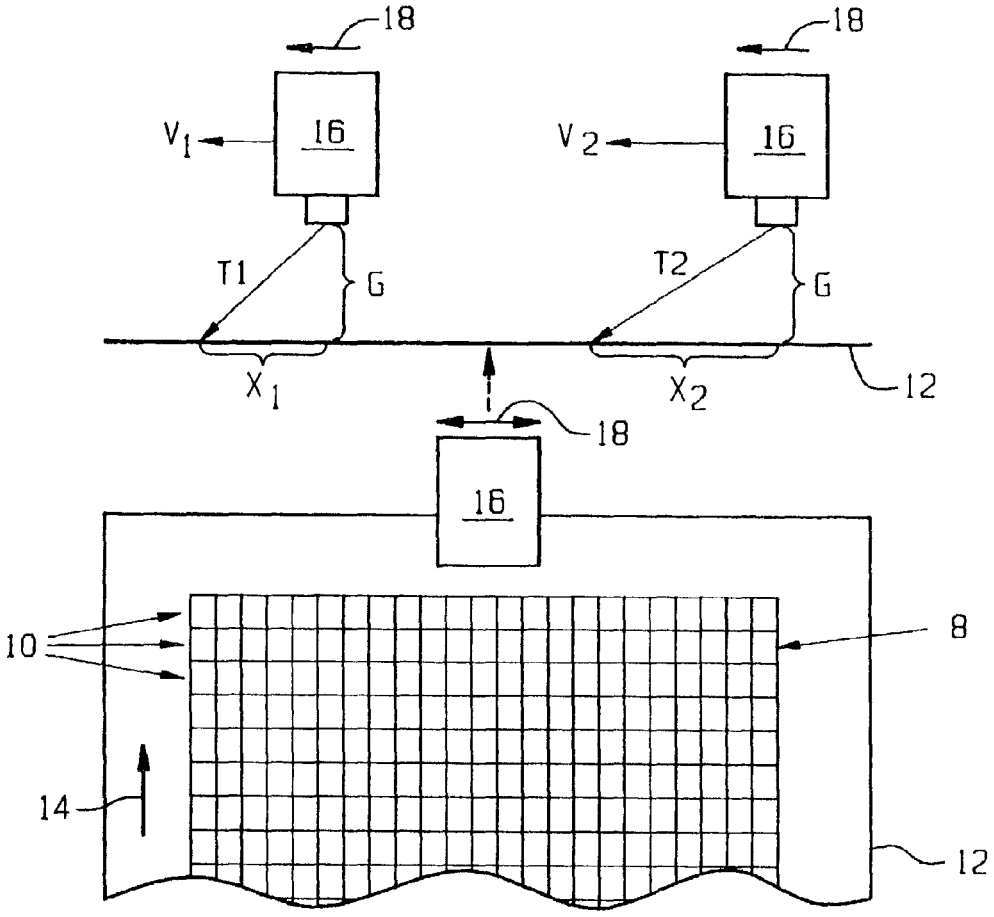
FIG. 1 illustrates relative ink drop placement locations on a print medium using a method of printing of the present invention.

Referring now to the drawings, and particularly to FIG. 1, there is shown an embodiment of a method of printing which alters the effective print resolution of an ink jet printer. An image area 8 defined by a 2 dimensional array of pixel locations including rows or scan lines 10 overlies a print medium 12 such as paper. Each horizontal row or scan line 10 in the 2 dimensional array includes a plurality of horizontally adjacent pixel locations which are spaced apart at a predetermined print resolution. For example, the plurality of pixels may have a center to center distance of 600 dpi or 1200 dpi.

Print medium 12 is advanced through a print zone in the ink jet printer in an advance direction 14. A printhead 16 is moveable in a bi-directional manner in scan directions 18 across the width of image area 8. Printhead 16, in known manner, includes one or more columns of ink jetting orifices (not shown) which are successively associated with different scan lines 10 within image area 8. As print medium 12 is advanced in advance direction 14, a particular ink jetting orifice becomes associated with a different scan line 10. Printhead 16, also in known manner, is typically carried by an ink jet cartridge (not shown), which in turn is carried by a carrier (not shown) which is moveable in a selected one of the scan directions 18.

The top portion of FIG. 1 shows an edge view of print medium 12 which is moveable in advance direction 14 perpendicular to and away from the plane of view. Printhead 16 is shown at 2 different positions across a scan line. As shown by the position of printhead 16 on the left, printhead 16 is spaced from the scan line at a gap distance G. Printhead 16 moves at a first scan velocity V1 in scan direction 18 across print medium 12. Because of the velocity component imparted by first scan velocity V1 to the ink drop which is jetted from printhead 16, the actual trajectory T1 of the ink drop is as shown. Thus, an ink drop is fired from an ink jetting orifice from printhead 16 at a preselected firing position in order to effect placement at an ink drop placement location which is a distance X1 away from the firing position.

Referring now to the position of printhead 16 at the top, right portion of FIG. 1, printhead 16 is also moved in a scan direction 18 across a scan line at a second scan velocity V2 having a magnitude which is greater than the magnitude of first scan velocity V1. Since the velocity component Vdrop in the direction of gap G remains constant while the velocity component in scan direction 18 increases in magnitude, the resultant ink drop placement location is spaced a further distance X2 away from the firing position of printhead 16. Thus, it is possible to change the ink drop placement location from a pre-selected firing position by varying the magnitude of second scan velocity V2.

Figure 2:
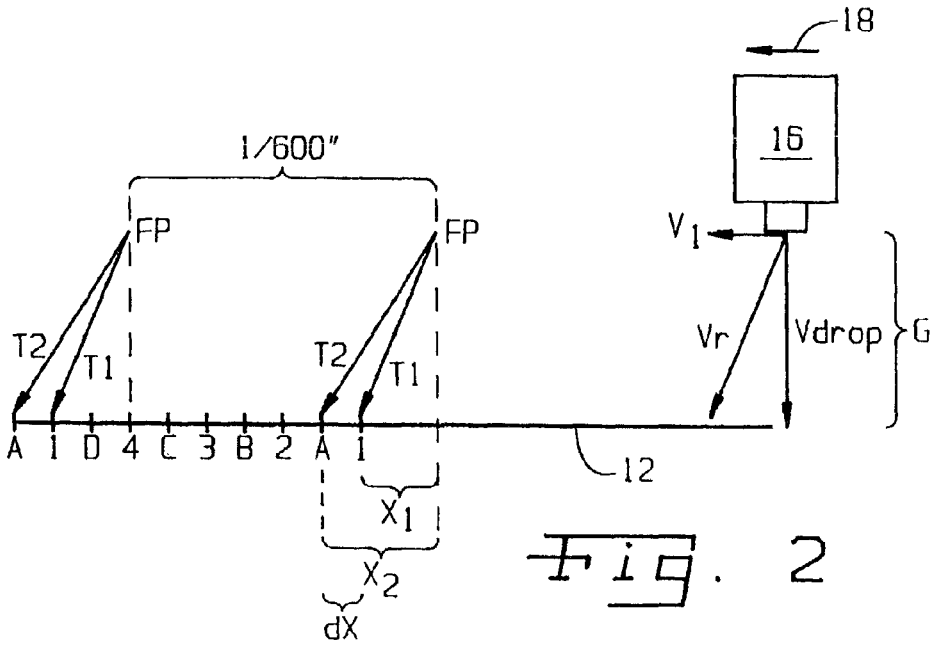
FIG. 2 is a more detailed illustration of ink drop placement locations for a pre-determined print resolution which occur as a result of a change of velocity between scans of the printhead.

Referring now to FIG. 2, a method of altering the effective print resolution of an ink jet printer of the present invention using a particular example is shown and will be described. Print medium 12 is again shown in an edge view and moveable in a direction perpendicular to and away from the plane of view. Printhead 16 is assumed to be scanned in a scan direction 18 which is from right to left, but may also be vice versa for bi-directional printers. Printhead 16 fires ink drops at selected firing positions as it scans across the scan line to place ink drops at selected ink drop placement locations corresponding to horizontally adjacent pixels on the scan line. The ink drop moves with a velocity component Vdrop in a direction toward print medium 12, and moves at first scan velocity V1 in scan direction 18, thereby causing a resultant velocity component Vr. Because of the resultant in the velocity component Vr, the corresponding resultant ink drop placement location in positional terms is offset from the firing position of the printhead as it passes over a scan line.

Referring to the left hand portion of FIG. 2, printhead 16 is assumed to fire ink drops at firing positions FP which are 1/600 hundredths of an inch (600 dpi) apart from each other. The ink drop trajectory at adjacent firing positions spaced 600 dpi apart during a first scan at a first scan velocity are labeled with reference T1. As is apparent, the ink drop placement location is spaced apart a distance X1 from a corresponding firing position FP.

During a second scan of printhead 16 across a scan line 10 on print medium 12, an ink drop is fired from an ink jetting orifice at the same firing position FP but at a second scan velocity V2 which result in the ink drop trajectory labeled with reference T2. The ink drop placement location is thus spaced apart a distance X2 from the firing position FP so that the print resolution may be altered.

In the embodiment shown, and as will be described in more detail hereinafter, the spacing between the ink drop placement locations between the first and second scans is 4800 dpi.

In the example shown, printhead 16 fires ink drops at selected firing positions which are spaced apart 600 dpi from each other. Nonetheless, using the method of the present invention, printhead 16 prints at a print resolution of 2400 dpi during successive first scans and at a print resolution of 2400 dpi during successive second scans resulting in an effective print resolution of 4800 dpi.

More particularly, printhead 16 is moved during successive first scans at first scan velocity V1 across print medium 16 and selectively fired at firing positions which are spaced 600 dpi apart. This results in ink drop placement locations represented by reference number 1 at the hash lines overlying print medium 12. Using the same firing position FP which resulted in placement of an ink drop at position 1 when printhead 16 is scanned at first scan velocity V1, the printhead 16 is scanned during a second scan at second scan velocity V2 which causes a different ink drop trajectory represented by trajectory line T2 which places an ink drop at the position represented by hash line A.

Between successive first scans, printhead 16 is shifted to a different start position a distance of 2400 dpi (i.e., ¼ of the 600 dpi print resolution). Printhead 16 is again scanned across the print medium 12; however, the firing positions FP have been shifted by 2400 dpi because of the different start position. This results in an ink drop placement location represented by hash line 2 on print medium 12. Using the same firing position FP which resulted in placement of an ink drop at position 2 when printhead 16 is scanned at first scan velocity V1, the printhead 16 is scanned during a second scan at second scan velocity V2 which causes a different ink drop trajectory represented by trajectory line T2 which places an ink drop at the position represented by hash line B.

Printhead 16 is then shifted another bi-directional alignment value of 2400 dpi and scanned at a first scan velocity V1 to place an ink drop at hash line 3. Printhead 16 is subsequently scanned at second scan velocity V2 using the same firing position to selectively place an ink drop at hash line C.

Printhead 16 is then shifted another bi-directional alignment value of 2400 dpi and scanned at a first scan velocity V1 to selectively place an ink drop at hash line 4. Printhead 16 is then scanned at a second scan velocity V2 using the same firing positions to selectively place an ink drop at hash line D. This process is repeated for each scan line 10 on image area 8 to selectively print the entire image area 8 at an effective print resolution of 4800 dpi.

Of course, the actually effective print resolution which is achieved using the method of the present invention may vary from one application to another. In the example shown, the second scan velocity V2 has a magnitude which is greater than the first scan velocity V1 by a predetermined amount in order to achieve a desired effective print resolution. However, the second scan velocity can be any desired value which is necessary to place ink drops at selected locations, depending upon the particular application. The second scan velocity can even be less than the first scan velocity if desired.

A method of determining a second scan velocity in order to achieve a desired spacing between ink drops during first and second scans using the same firing positions will now be described in greater detail.

The associated variables are the velocity of the ink drop (Vdrop), the printhead to paper gap (G), the carrier velocities of interest (V1 and V2), and the corresponding displacements in drop location (X1 and X2). The flight time (Tf) of the drop is given by the mathematical expression:

$$Tf=G/V\text{drop}$$

Therefore, the drop displacement due to carrier velocity is defined as:

$$X1=V1*Tf \text{ and } X2=V2*Tf$$

The goal is to determine V2 such that the difference dX between X1 and X2 is some defined distance:

$$X2=X1+dX$$

Solving for V2 yields:

$$V2=V1+dX/Tf$$

or $$dV=dX/Tf=V\text{drop}*dX/G \qquad \text{(Equation 1)}$$

Figure 3:
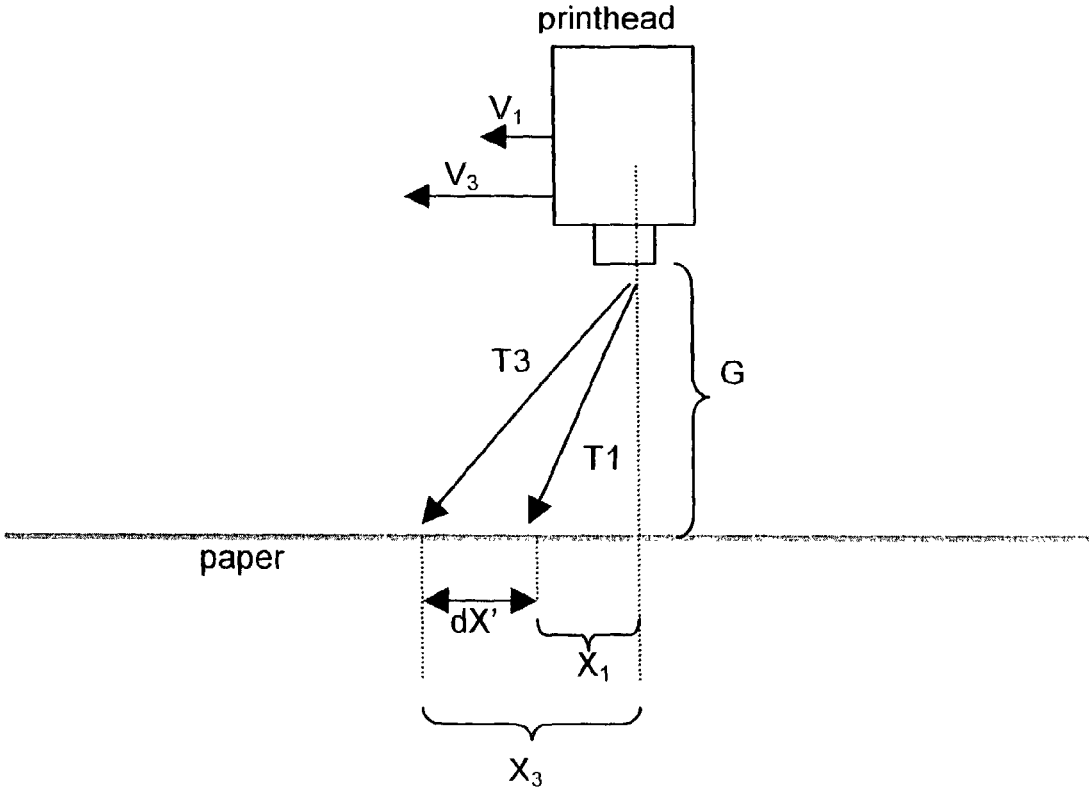
FIG. 3 illustrates a method of determining the offset between the ink drop placement locations associated with different printhead velocities.

One could either assume some nominal values of G and Vdrop to compute dV, or extract this information from measured alignment distances. This alignment distance can be determined from printing uni-directionally at 2 velocities, such as shown in FIG. 3. The distance between drops printed at V1 and V3 is measured, called dX'. This value is used to determine dV for the desired displacement dX as follows:

$$dV=dX*(V3-V1)/dX' \qquad \text{(Equation 2)}$$

Figure 4:
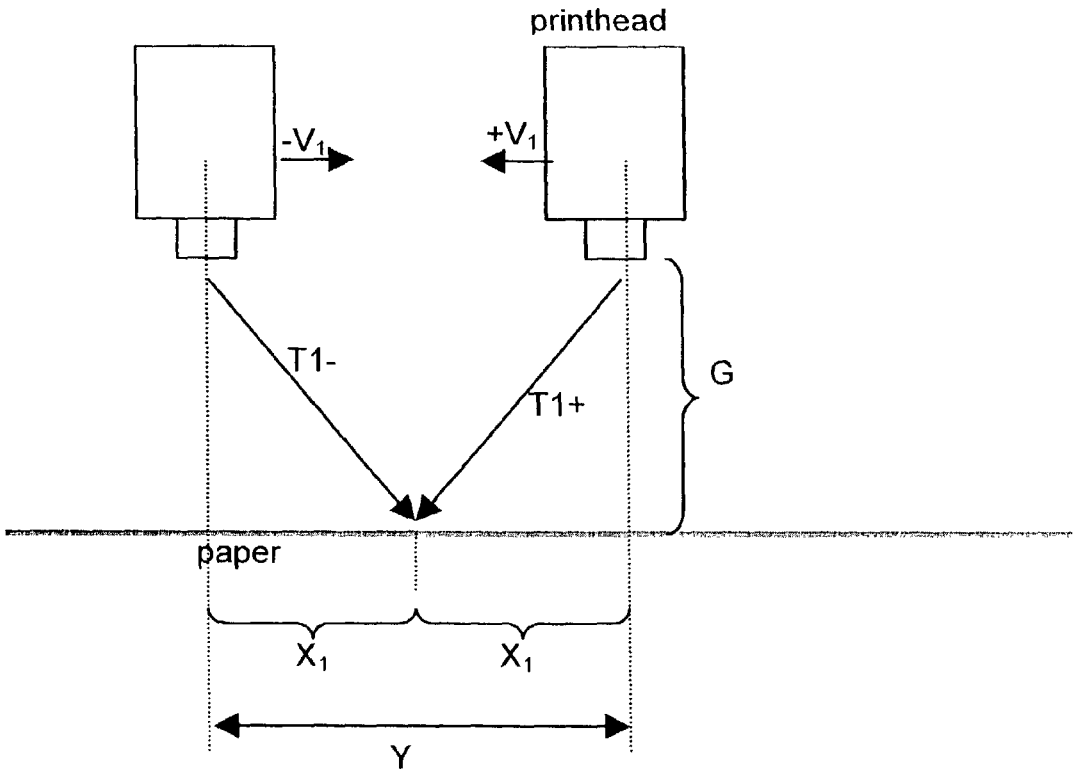
FIG. 4 illustrates an alternative method of determining the offset between the ink drop placement locations associated with different printhead velocities Corresponding reference characters indicate corresponding parts throughout the several views. The exemplification set out herein illustrates one exemplary embodiment of the invention, in one form, and such exemplification is not to be construed as limiting the scope of the invention in any manner.

Alternatively, the same information can be extracted from bi-directional alignment as shown in FIG. 4. The bi-directional alignment distance Y is equal to 2*X1, assuming alignment is performed at carrier velocity V1. Thus, solving for dV without prior knowledge of Vdrop and G yields:

$$dV=V1*dX/(Y/2)$$

For example, if an adjustment of dX=1/4800" is desired, and Vdrop=500 ips, and G=0.05", equation 1 then provides a dV=2.08 ips. Equation 2 can be used to adjust for variations in machines and printheads. For example, if the alignment at V1=30 ips was measured to be Y=8/1200", then dV 1.875 ips.

While this invention has been described with respect to an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of printing using an ink jet printer, comprising the steps of:

defining at least one scan line with a plurality of pixel locations spaced apart at a predetermined print resolution;

scanning a printhead across said scan line at a first scan velocity;

printing on said scan line at selected said pixel locations at said first scan velocity;

scanning said printhead across said scan line at a second scan velocity, said second scan velocity being different from said first scan velocity;

printing on said scan line at selected said pixel locations at said second scan velocity; and preselecting a distance (dX) between adjacent ink dot placement locations associated with a respective said pixel location a change in velocity (dV) between said first scan velocity and said second scan velocity being represented by the mathematical expression:

$$dV=V1*dX/(Y/2)$$

wherein:

V1=said first scan velocity; and

Y=an alignment value.

2. The method of printing of claim 1, including the steps of:

associating a plurality of firing positions respectively with each of said pixel locations, each said pixel location having a respective unique said firing position; and selectively printing at each said pixel location using said respective unique firing position during each of said first and second printing steps.

3. The method of printing of claim 2, wherein said unique firing position associated with each said pixel location corresponds to two separate ink dot placement locations associated with said respective pixel location during said first and second printing steps.

4. The method of printing of claim 1, wherein said first and second printing steps are carried out to alter an effective print resolution of said ink jet printer.

5. The method of printing of claim 4, wherein said effective print resolution is doubled.

6. The method of printing of claim 5, wherein an ink dot placement location of an ink dot placed during said second printing step is approximately midway between adjacent ink dot placement locations of ink dots placed during said first printing step.

7. The method of printing of claim 1, wherein said at least one scan line comprises a plurality of scan lines.

8. A method of printing using an ink jet printer, comprising the steps of:

defining at least one scan line with a plurality of pixel locations spaced apart at a predetermined print resolution;

scanning a printhead across said scan line at a first scan velocity;

printing on said scan line at selected said pixel locations at said first scan velocity;

scanning said printhead across said scan line at a second scan velocity, said second scan velocity being different from said first scan velocity;

printing on said scan line at selected said pixel locations at said second scan velocity;

associating a plurality of firing positions respectively with each of said pixel locations, each said pixel location having a respective unique said firing position; and selectively printing at each said pixel location using said respective unique firing position during each of said first and second printing steps, said unique firing position associated with each said pixel location corresponds to two separate ink dot placement locations associated with said respective pixel location during said first and second printing steps, a distance (dX) is preselected between adjacent said ink dot placement locations associated with a respective said pixel location, a change in velocity (dV) between said first scan velocity and said second scan velocity being represented by the mathematical expression:

$$dV=V1*dX/(Y/2)$$

wherein:

V1=said first scan velocity; and

Y=an alignment value.

9. The method of printing of claim 8, wherein said alignment value Y is directly proportional to 2*X1, wherein X1 is a distance between said ink dot placement location during said first scan and said respective firing position.

10. A method of altering the effective print resolution of an ink jet printer, comprising the steps of:

defining at least one scan line having a predetermined print resolution;

scanning a printhead during a first scan across said scan line at a first scan velocity;

printing on said scan line during said first scan at said predetermined print resolution;

scanning said printhead during a second scan across said scan line at a second scan velocity, said second scan velocity being different from said first scan velocity;

printing on said scan line during said second scan at said predetermined print resolution, thereby altering the effective print resolution of said ink jet printer; and preselecting a distance (dX) between adjacent ink dot placement locations associated with a pixel location on said scan lines a change in velocity (dV) between said first scan velocity and said second scan velocity being represented by the mathematical expression:

$$dV=V1*dX/(Y/2)$$

wherein:

V1=said first scan velocity; and

Y=an alignment value.

11. The method of altering the effective print resolution of an ink jet printer of claim 10, wherein said at least one scan line is defined with a plurality of pixel locations spaced apart at a predetermined resolution, and including the further steps of:

associating a plurality of firing positions respectively with each of said pixel locations, each said pixel location having a respective unique said firing position; and selectively printing at each said pixel location using said respective unique firing position during each of said first and second printing steps.

12. The method of altering the effective print resolution of an ink jet printer of claim 11, wherein said unique firing position associated with each said pixel location corresponds to two separate ink dot placement locations associated with said respective pixel location during said first and second printing steps.

13. The method of altering the effective print resolution of an ink jet printer of claim 10, wherein said effective print resolution is doubled.

14. The method of altering the effective print resolution of an ink jet printer of claim 13, wherein an ink dot placement location of an ink dot placed during said second printing step is approximately midway between adjacent ink dot placement locations of ink dots placed during said first printing step.

15. The method of altering the effective print resolution of an ink jet printer of claim 10, wherein said at least one scan line comprises a plurality of scan lines.

16. A method of altering the effective print resolution of an ink jet, comprising the steps of:

defining at least one scan line having a predetermined print resolution;

scanning a printhead during a first scan across said scan line at a first scan velocity;

printing on said scan line during said first scan at said predetermined print resolution;

scanning said printhead during a second scan across said scan line at a second scan velocity, said second scan velocity being different from said first scan velocity;

printing on said scan line during said second scan at said predetermined print resolution, thereby altering the effective print resolution of said ink jet printer, said at least one scan line being defined with a plurality of pixel locations spaced apart at a predetermined resolution, associating a plurality of firing positions respectively with each of said pixel locations, each said pixel location having a respective unique said firing position; and selectively printing at each said pixel location using said respective unique firing position during each of said first and second printing steps, said unique firing position associated with each said pixel location corresponds to two separate ink dot placement locations associated with said respective pixel location during said first and second printing steps, a distance (dX) is preselected between adjacent said ink dot placement locations associated with a respective said pixel location, a change in velocity (dV) between said first scan velocity and said second scan velocity being represented by the mathematical expression:

$$dV=V1*dX/(Y/2)$$

wherein:

V1=said first scan velocity; and

Y=an alignment value.

17. The method of altering the effective print resolution of an ink jet printer of claim 16, wherein said alignment value Y is directly proportional to 2*X1, wherein X1 is a distance between said ink dot placement location during said first scan and said respective firing position.

* * * * *